US011408677B2

(12) United States Patent
Arai et al.

(10) Patent No.: US 11,408,677 B2
(45) Date of Patent: Aug. 9, 2022

(54) MODULE FOR NATURAL GAS LIQUEFIER APPARATUS AND NATURAL GAS LIQUEFIER APPARATUS

(71) Applicant: JGC CORPORATION, Yokohama (JP)

(72) Inventors: Yoji Arai, Kanagawa (JP); Motobumi Kagawa, Kanagawa (JP); Masayuki Tanabe, Kanagawa (JP); Takashi Nozato, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 376 days.

(21) Appl. No.: 16/603,836

(22) PCT Filed: May 30, 2017

(86) PCT No.: PCT/JP2017/020056
§ 371 (c)(1),
(2) Date: Oct. 9, 2019

(87) PCT Pub. No.: WO2018/220703
PCT Pub. Date: Dec. 6, 2018

(65) Prior Publication Data

US 2020/0041202 A1 Feb. 6, 2020

(51) Int. Cl.
*F25J 1/02* (2006.01)
*F25J 1/00* (2006.01)

(52) U.S. Cl.
CPC ..... *F25J 1/0259* (2013.01); *F25J 1/0022* (2013.01); *F25J 1/0052* (2013.01); *F25J 1/0055* (2013.01);
(Continued)

(58) Field of Classification Search
CPC ..... F25J 1/0259; F25J 1/0022; F25J 2220/60; F25J 2220/64; F25J 2220/66;
(Continued)

(56) References Cited

U.S. PATENT DOCUMENTS 4,041,721 A * 8/1977 Kniel ..... F25J 1/0283 62/53.2
2014/0053599 A1* 2/2014 Byfield ..... F25J 1/0216 62/611
(Continued)

FOREIGN PATENT DOCUMENTS

JP 2016514823 5/2016
RU 2275562 4/2006
(Continued)

OTHER PUBLICATIONS

API Recommended Practice 2001 Fire Protection in Refineries Seventh Edition, Jun. 1998 (Year: 1998).*
(Continued)

*Primary Examiner* — Brian M King
(74) *Attorney, Agent, or Firm* — JCIPRNET

(57) ABSTRACT

A module for a natural gas liquefaction apparatus is provided to include air-cooled heat exchanger groups and another equipment group. The air-cooled heat exchanger groups another equipment group. The air-cooled heat exchanger groups are arranged side by side on an upper surface of a structure, and are each configured to cool a fluid handled in the natural gas liquefaction apparatus. The another equipment group is arranged on a lower side from an arrangement height of each air-cooled heat exchanger groups, and forms a part of the natural gas liquefaction apparatus. When equipment groups are classified into a pretreatment unit equipment group provided in a pretreatment unit configured to perform pretreatment of natural gas before being liquefied, and a liquefaction processing unit equipment group provided in a liquefaction processing unit associated with processing of liquefying the natural gas after being treated in the pretreatment unit, the another equipment group is formed of the pretreatment unit equipment group.

12 Claims, 4 Drawing Sheets

(52) U.S. Cl.
CPC ..... *F25J 1/0216* (2013.01); *F25J 2205/80* (2013.01); *F25J 2220/02* (2013.01); *F25J 2220/66* (2013.01); *F25J 2220/68* (2013.01)

(58) Field of Classification Search
CPC ..... F25J 2220/68; F25J 1/0258; F25J 1/0257; F25J 1/0261; F25J 2290/42
See application file for complete search history.

(56) References Cited

U.S. PATENT DOCUMENTS

| | | | | |
|---|---|---|---|---|
| 2015/0204604 | A1* | 7/2015 | Varrassi | F17C 13/126 62/47.1 |
| 2016/0010916 | A1* | 1/2016 | Byfield | F28F 9/26 62/611 |
| 2016/0116209 | A1* | 4/2016 | Nagao | F25J 1/0242 62/611 |
| 2017/0097188 | A1* | 4/2017 | Lupascu | F25J 1/0057 |
| 2017/0097189 | A1* | 4/2017 | Guy | F25J 1/0082 |

FOREIGN PATENT DOCUMENTS

| | | |
|---|---|---|
| RU | 2451250 | 5/2012 |
| WO | 9713108 | 4/1997 |
| WO | 2014028961 | 2/2014 |
| WO | 2017062155 | 4/2017 |

OTHER PUBLICATIONS

Office Action of Russia Counterpart Application, with English translation thereof, dated Sep. 9, 2020, pp. 1-12.
"International Search Report (Form PCT/ISA/210) of PCT/JP2017/020056", dated Aug. 1, 2017, with English translation thereof, pp. 1-2.

* cited by examiner

MODULE FOR NATURAL GAS LIQUEFIER APPARATUS AND NATURAL GAS LIQUEFIER APPARATUS

CROSS-REFERENCE TO RELATED APPLICATION

This application is a 371 application of the International PCT application serial no. PCT/JP2017/020056, filed on May 30, 2017. The entirety of the abovementioned patent application is hereby incorporated by reference herein and made a part of this specification.

TECHNICAL FIELD

The present invention relates to a technology for constructing a natural gas liquefaction apparatus configured to liquefy natural gas.

BACKGROUND ART

A natural gas liquefaction apparatus (NG liquefaction apparatus) is a facility configured to cool and liquefy natural gas (NG) produced in a gas well or the like to produce liquefied natural gas (LNG).

In recent years, in construction of the NG liquefaction apparatus, an attempt has been made to modularize the NG liquefaction apparatus by dividing a large number of equipment forming the NG liquefaction apparatus into blocks and incorporating an equipment group of each of the blocks into a common structure (for example, Patent Literature 1).

When the NG liquefaction apparatus is modularized, as the number of constraints on the equipment capable of being incorporated into the common structure is smaller, module designing with a higher degree of freedom can be performed.

In addition, when the integration degree (for example, the number of equipment that can be arranged per unit volume in the structure) of each module forming the NG liquefaction apparatus can be increased, it is also possible to reduce cost and man-hour required for conveyance and assembly in a case of conveying modules built in another place to an installation site to construct the NG liquefaction apparatus.

Meanwhile, in the NG liquefaction apparatus configured to handle a combustible liquid and a cryogenic liquid, it is required to perform module designing in which priority is given to safety.

CITATION LIST

Patent Literature

[PTL 1] WO 2014/028961 A1

SUMMARY OF INVENTION

Technical Problem

The present invention has been made in view of the above-mentioned circumstances and has an object to provide a module for a natural gas liquefaction apparatus, which has a high integration degree on the premise of an optimum equipment arrangement from the viewpoint of economic efficiency and safety with a focus being given on a range of a refractory covering, and a natural gas liquefaction apparatus including the module for a natural gas liquefaction apparatus.

Solution to Problem

According to one embodiment of the present invention, there is provided a module for a natural gas liquefaction apparatus for configuring a natural gas liquefaction apparatus, the module for a natural gas liquefaction apparatus including: a structure; air-cooled heat exchanger groups, which are arranged side by side on an upper surface of the structure, and are each configured to cool a fluid handled in the natural gas liquefaction apparatus; and another equipment group, which is arranged on a lower side from an arrangement height of each of the air-cooled heat exchanger groups in the structure, and forms a part of the natural gas liquefaction apparatus, wherein, when equipment groups forming the natural gas liquefaction apparatus are classified into a pretreatment unit equipment group provided in a pretreatment unit configured to perform pretreatment of natural gas before being liquefied, and a liquefaction processing unit equipment group provided in a liquefaction processing unit associated with processing of liquefying the natural gas after being treated in the pretreatment unit, the another equipment group is formed of the pretreatment unit equipment group.

The module for a natural gas liquefaction apparatus may have the following features.

(a) The structure is partitioned into an arrangement area in which the air-cooled heat exchanger group is arranged on the upper surface of the structure and a non-arrangement area in which the air-cooled heat exchanger group is prevented from being arranged on the upper surface of the structure. Among equipments included in the another equipment group, only a non-handling equipment is provided in the structure on the arrangement area side, the non-handling equipment being prevented from handling a liquid selected from a liquid group consisting of a combustible liquid, a flammable liquid, liquefied natural gas, and liquefied petroleum gas, and remaining equipment is provided in the structure on the non-arrangement area side.

(b) The structure is partitioned into an arrangement area in which the air-cooled heat exchanger group is arranged on the upper surface of the structure and a non-arrangement area in which the air-cooled heat exchanger group is prevented from being arranged on the upper surface of the structure. Among equipments included in the another equipment group, a handling equipment is provided in the structure on the arrangement area side, the handling equipment being configured to handle a liquid selected from a liquid group consisting of a combustible liquid, a flammable liquid, liquefied natural gas, and liquefied petroleum gas. At least one security facility selected from a security facility group consisting of a gas detector, a sprinkler, a refractory cover, and a depressurized line is provided in parallel to the handling equipment provided in the structure on the arrangement area side.

(c) The structure is partitioned into an arrangement area in which the air-cooled heat exchanger group is arranged on the upper surface of the structure and a non-arrangement area in which the air-cooled heat exchanger group is prevented from being arranged on the upper surface of the structure. The another equipment group arranged in the structure includes equipment included in the liquefaction processing unit equipment group in addition to the pretreatment unit equipment group or in place of the pretreatment unit equipment group, and the equipment included in the liquefaction processing unit equipment group is provided in the structure on the non-arrangement area side. At this time, the equipment included in the liquefaction processing unit equipment group is equipment configured to deliver the liquefied natural gas from the natural liquefaction apparatus.

(d) The pretreatment unit includes at least one pretreatment unit selected from a pretreatment unit group consisting of a gas-liquid separation unit configured to separate a liquid component contained in the natural gas, a mercury removal unit configured to remove mercury contained in the natural gas, an acid gas removal unit configured to remove acid gas contained in the natural gas, a moisture removal unit configured to remove moisture contained in the natural gas, and a heavy component removal unit configured to remove a heavy component contained in the natural gas.

Further, according to another embodiment of the present invention, there is provided a natural gas liquefaction apparatus, including: a plurality of modules for the above-mentioned natural gas liquefaction apparatus; and another module for a natural gas liquefaction apparatus in which the liquefaction processing unit equipment group is provided in a structure.

Advantageous Effects of Invention

According to the present invention, of the equipment groups forming the natural gas liquefaction apparatus, the pretreatment unit equipment group for pretreatment of the natural gas and the air-cooled heat exchanger group, in which the occupancy rate of the equipment configured to handle a combustible liquid and a cryogenic liquid in the module is low, are arranged in the common structure, to thereby configure the module for a natural gas liquefaction apparatus. As a result, a module for a natural gas liquefaction apparatus having a high integration degree can be configured while the influence of liquid pool fire on a region requiring a refractory covering based on International Design Standards (API2218) described later is minimized as compared to a liquefaction processing unit equipment group for liquefaction of the natural gas, in which the occupancy rate of the equipment configured to handle combustible and cryogenic liquids is high.

DESCRIPTION OF EMBODIMENTS

Figure 1:
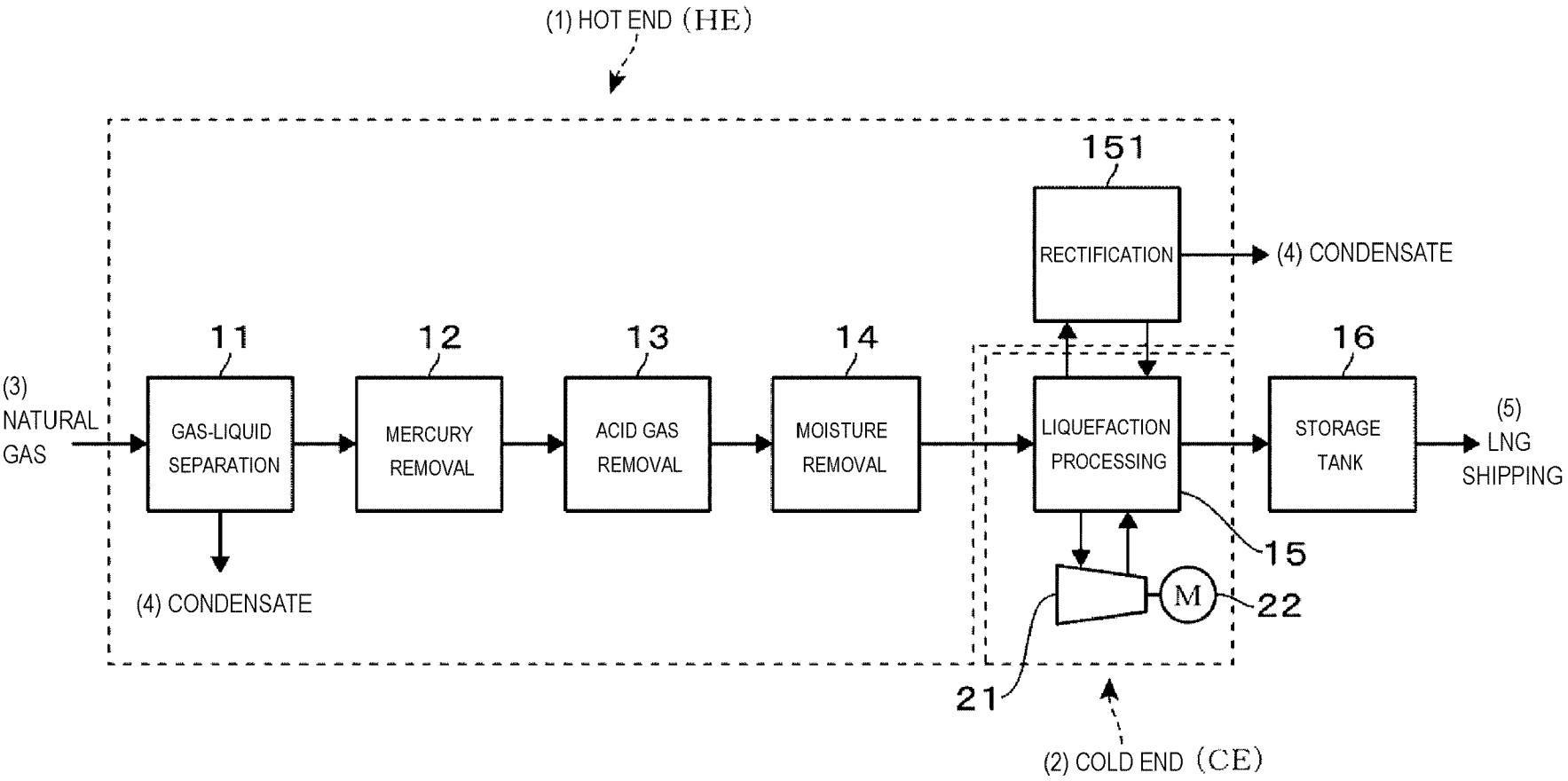
FIG. 1 is a diagram for illustrating a configuration example of each processing block included in a natural gas liquefaction apparatus.

FIG. 1 is a diagram for illustrating one example of a schematic configuration of a natural gas (NG) liquefaction apparatus that is configured through use of a module for a natural gas liquefaction apparatus according to an embodiment of the present invention.

The NG liquefaction apparatus includes a gas-liquid separation block (gas-liquid separation unit) 11, a mercury removing block (mercury removal unit) 12, an acid gas removing block (acid gas removal unit) 13, a moisture removing block (moisture removal unit) 14, a liquefaction processing block (liquefaction processing unit) 15, and a storage tank 16. The gas-liquid separation block 11 is configured to separate a liquid from NG The mercury removing block 12 is configured to remove mercury from the NG The acid gas removing block 13 is configured to remove acid gas, such as carbon dioxide and hydrogen sulfide, from the NG The moisture removing block 14 is configured to remove a trace amount of moisture contained in the NG The liquefaction processing block 15 is configured to cool and liquefy the NG having those impurities removed therefrom to obtain LNG The storage tank 16 is configured to store the liquefied LNG The gas-liquid separation block 11 is configured to separate a condensate, which is a liquid at normal temperature, contained in the NG transported through a pipeline or the like. For example, the gas-liquid separation block 11 includes an equipment group including, for example, an elongated pipe and a drum, a regeneration column and a reboiler of an antifreeze liquid, and supplementary facilities thereof. The elongated pipe and the drum are arranged so as to be inclined, and are configured to separate a liquid from the NG through use of a difference in specific gravity. The regeneration column and the reboiler of an antifreeze liquid are configured to regenerate and heat an antifreeze liquid to be added as necessary in order to prevent clogging in the pipeline in the process of transportation.

The mercury removing block 12 is configured to remove a trace amount of mercury contained in the NG having the liquid separated therefrom. For example, the mercury removing block 12 includes an equipment group including, for example, a mercury adsorption column in which a mercury removal agent is filled in an adsorption column and supplementary facilities thereof.

The acid gas removing block 13 is configured to remove acid gas, such as carbon dioxide and hydrogen sulfide, which are liable to be solidified in LNG at a time of liquefaction. As a method of removing the acid gas, there are given a procedure using a gas absorbing liquid containing an amine compound or the like and a procedure using a gas separation membrane that allows acid gas in the NG to pass therethrough.

When the gas absorbing liquid is adopted, the acid gas removing block 13 includes an equipment group including, for example, an absorption column, a regeneration column, a reboiler, and supplementary facilities thereof. The absorption column is configured to bring the natural gas and the gas absorbing liquid into countercurrent contact with each other. The regeneration column is configured to regenerate the gas absorbing liquid having absorbed the acid gas. The reboiler is configured to heat the gas absorbing liquid in the regeneration column.

In addition, when the gas separation membrane is adopted, the acid gas removing block 13 includes an equipment group including, for example, a gas separation unit configured to accommodate a large number of hollow fiber membranes in a main body and supplementary facilities thereof.

The moisture removing block 14 is configured to remove a trace amount of moisture contained in the NG For example, the moisture removing block 14 includes an equipment group including, for example, a plurality of adsorption columns, a heater, and supplementary facilities thereof. In the plurality of adsorption columns, an adsorbent, such as a molecular sieve or silica gel, is filled, and a moisture removing operation of the NG and a regeneration operation of the adsorbent having adsorbed moisture are alternately switched to be performed. The heater is configured to heat regeneration gas (for example, the NG having the moisture removed therefrom) for the adsorbent supplied to the adsorption column in which the regeneration operation is performed.

The NG having the impurities removed therefrom by various processing blocks described above is supplied to the liquefaction processing block 15 to be liquefied. The liquefaction processing block 15 includes equipment such as a precooling heat exchanger, a scrub column, a main cryogenic heat exchanger (MCHE), a refrigerant compressor 21, and supplementary facilities thereof. The precooling heat exchanger is configured to precool the NG with precooling refrigerant containing propane as a main component. The scrub column is configured to remove a heavy component from the precooled NG The main cryogenic heat exchanger (MCHE) is configured to cool, liquefy, and subcool the NG with mixed refrigerant containing a plurality of kinds of refrigerant raw materials, such as nitrogen, methane, ethane, and propane. The refrigerant compressor 21 is configured to compress gas of the precooling refrigerant and the mixed refrigerant that are gasified by heat exchange.

In FIG. 1, each of the above-mentioned equipment is not shown except that individual refrigerant compressors (low-pressure MR compressor and high-pressure MR compressor for mixed refrigerant, and C3 compressor for precooling refrigerant) of the precooling refrigerant and the mixed refrigerant are collectively described as one component.

In addition, in FIG. 1, there is illustrated an example using a motor 22 as a power source configured to drive refrigerant compressors 21, but a gas turbine or the like may be used in accordance with the scale of the refrigerant compressors 21.

In addition, in a subsequent stage of each of the refrigerant compressors 21 of the liquefaction processing block 15, there are provided a large number of air-cooled heat exchangers (ACHEs) 41 configured to cool a fluid handled in the NG liquefaction apparatus. The air-cooled heat exchangers (ACHEs) 41 form various coolers configured to cool compressed refrigerant and a condenser, and a cooler and the like configured to cool the gas absorbing liquid regenerated in the regeneration column and a column top liquid in a case in which the acid gas removing block 13 uses the gas absorbing liquid.

Further, a rectifying unit 151 is juxtaposed to the liquefaction processing block 15. The rectifying unit 151 includes a deethanizer configured to separate ethane from a liquid (liquid heavy component) separated from the cooled NQ a depropanizer configured to separate propane from the liquid having ethane separated therefrom, and a debutanizer configured to separate butane from the liquid having propane separated therefrom to obtain a condensate that is a liquid at normal temperature. The deethanizer, the depropanizer, and the debutanizer each include an equipment group including, for example, a rectifying column configured to rectify each component, a reboiler configured to heat the liquid in each rectifying column, and supplementary facilities thereof. The rectifying block 151 corresponds to a heavy component removal unit in the embodiment of the present invention.

Liquefied natural gas (LNG), which has been liquefied and subcooled in the liquefaction processing block 15, is fed to and stored in the storage tank 16. The LNG stored in the storage tank 16 is fed with an LNG pump (not shown) and shipped to an LNG tanker or a pipeline.

Here, in general, in the NG liquefaction apparatus, each of the processing blocks (gas-liquid separation block 11, mercury removing block 12, acid gas removing block 13, moisture removing block 14, and rectifying block 151) associated with the pretreatment before the NG is liquefied is referred to as "hot end (HE)", and the liquefaction processing block 15 (including each of the refrigerant compressors 21) configured to cool and liquefy the NG to obtain LNG is referred to as "cold end (CE)", to thereby classify those processing blocks in some cases.

Each of the processing blocks forming the HE corresponds to a pretreatment unit in the embodiment of the present invention, and an equipment group (hereinafter sometimes referred to as "HE-side equipment group") provided in each of the processing blocks corresponds to the pretreatment unit equipment group. In addition, the liquefaction processing block 15 forming the CE corresponds to the liquefaction processing unit in the embodiment of the present invention, and an equipment group (hereinafter sometimes referred to as "CE-side equipment group") provided in the liquefaction processing block 15 corresponds to a liquefaction processing unit equipment group.

As described above, the NG liquefaction apparatus described above by way of the configuration example includes a plurality of modules for an NG liquefaction apparatus, each being configured by classifying the equipment groups provided in the NG liquefaction apparatus into blocks, that is, the HE-side equipment group and the CE-side equipment group, and incorporating the equipment groups classified into the blocks into respective common structures.

Figure 2:
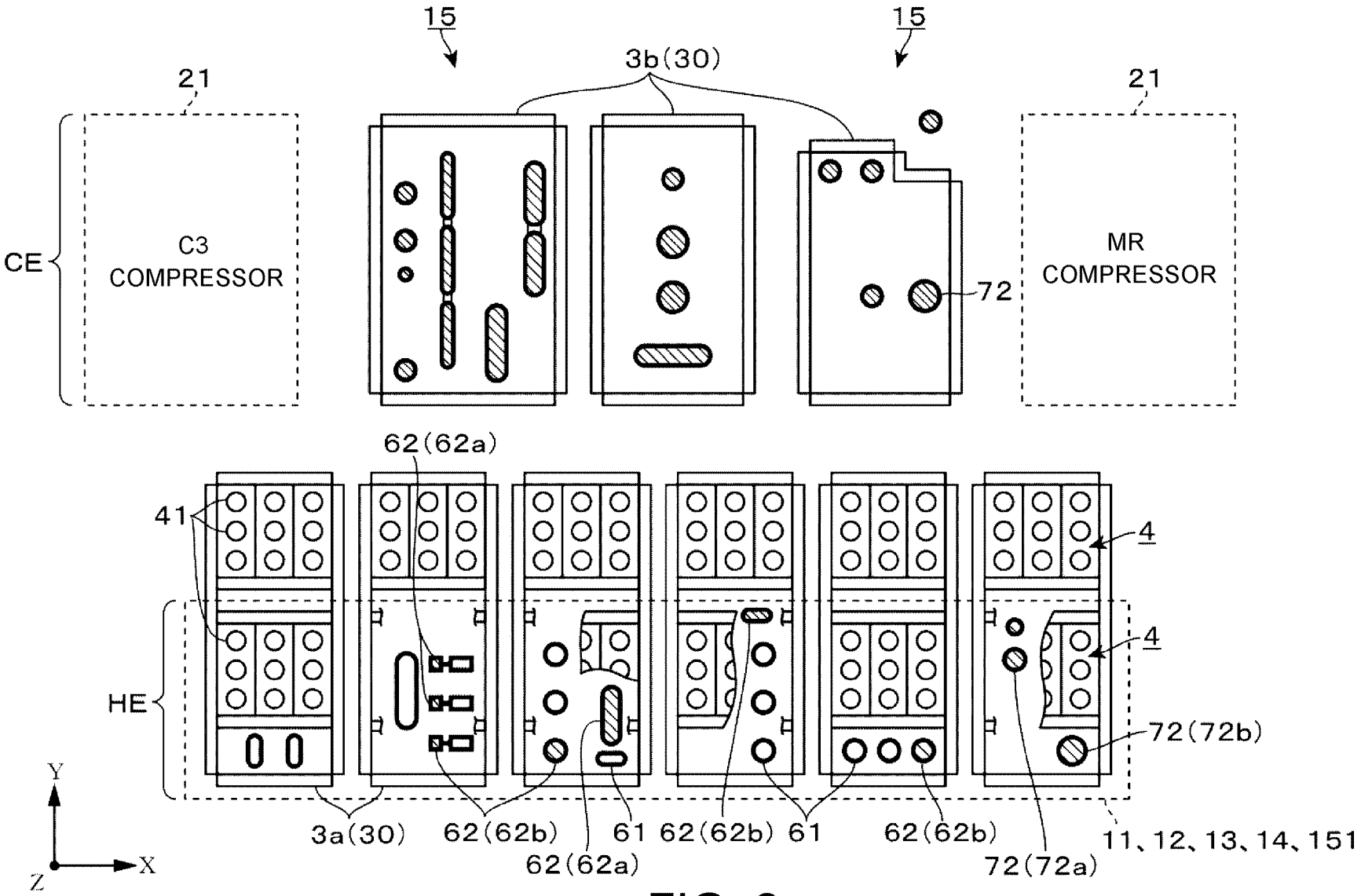
FIG. 2 is an exemplary plan view for illustrating layout of modules arranged in the natural gas liquefaction apparatus.
Figure 3:
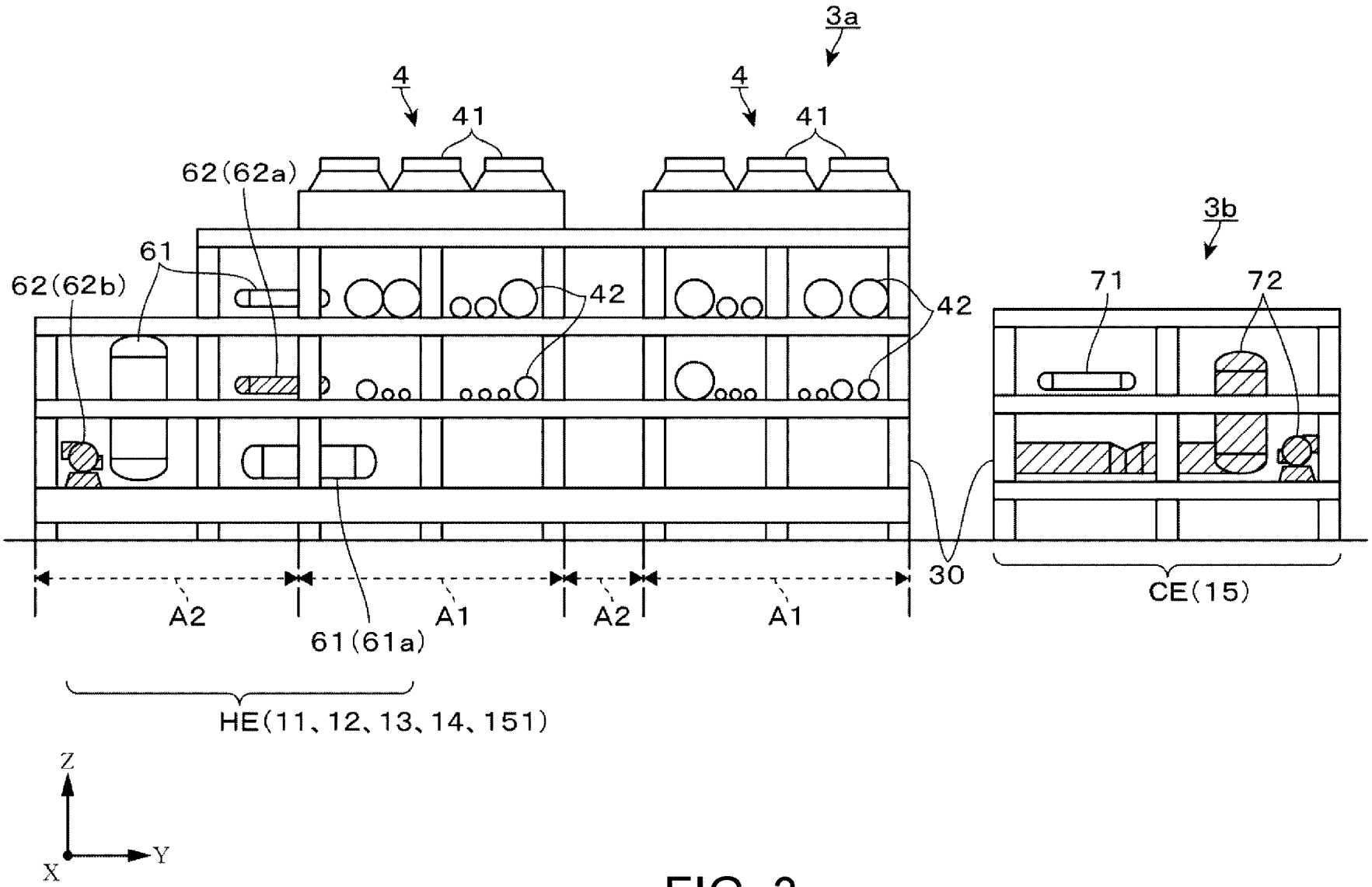
FIG. 3 is a side view of a module for a natural gas liquefaction apparatus according to an embodiment of the present invention.
Figure 4:
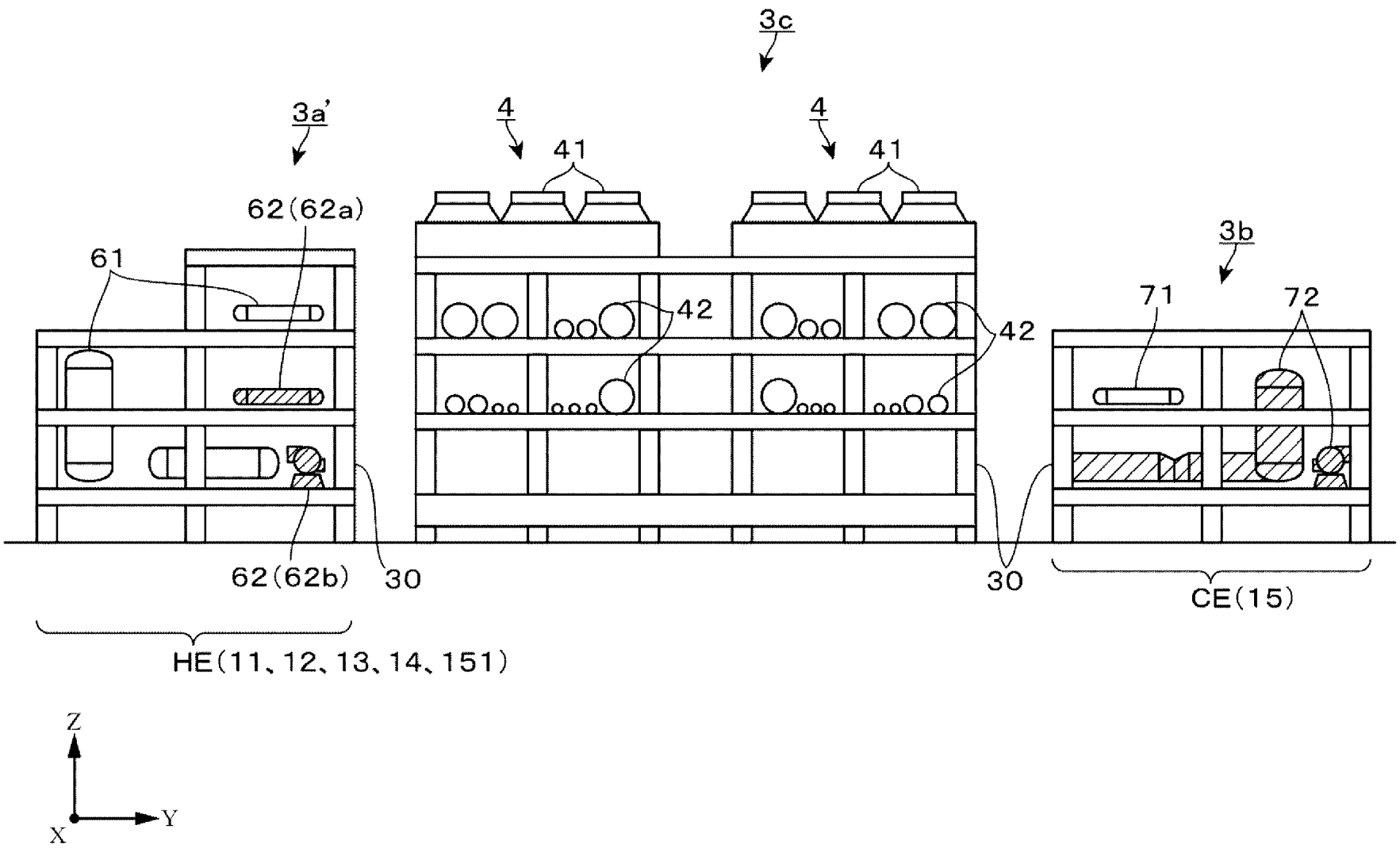
FIG. 4 is a side view of a related-art module for a natural gas liquefaction apparatus.

Now, a specific configuration of the module for an NG liquefaction apparatus is described also with reference to FIG. 2 to FIG. 4.

As illustrated in a plan view of FIG. 2, the NG liquefaction apparatus according to the embodiment of the present invention has a configuration in which a plurality of HE modules 3*a* and CE modules 3*b* are arranged in two columns in a front-and-back direction, and the refrigerant compressors 21, which are an MR compressor and a C3 compressor, are arranged on both sides of the column in which the CE modules 3*b* are arranged. In the NG liquefaction apparatus according to the embodiment of the present invention, the HE module 3*a* corresponds to "module for a natural gas liquefaction apparatus", and the CE module 3*b* corresponds to "another module for a natural gas liquefaction apparatus".

In the description given with reference to FIG. 2 to FIG. 4, an arrangement side of the column of the HE modules 3*a* along a Y-axis direction indicated in each of the figures is also referred to as "front side", and an arrangement side of the column of the CE modules 3*b* along the Y-axis direction is also referred to as "back side".

As illustrated in FIG. 3, each of the HE modules 3*a* has a structure in which the HE-side equipment group forming the processing blocks (gas-liquid separation block 11, mercury removing block 12, acid gas removing block 13, moisture removing block 14, and rectifying block 151) on the HE side is arranged in the structure 30. Further, in the HE module 3*a* according to the embodiment of the present invention, air-cooled heat exchanger (ACHE) groups 4 each including the plurality of ACHEs 41 are arranged on an upper surface side of the structure 30 common to the structure 30 in which the HE-side equipment group is arranged.

Meanwhile, each of the CE modules 3*b* has a structure in which the CE-side equipment group forming the liquefaction processing block 15 on the CE side is arranged in the structure 30, but the ACHE group 4 is not provided on the upper surface of the structure 30.

As described above, the NG liquefaction apparatus according to the embodiment of the present invention has a feature in that the equipment to be provided in the structure 30 common to that of the ACHE groups 4 are limited to those belonging to the HE-side equipment group to form the HE module 3*a*. Now, the reason for providing such a limitation is described.

FIG. 4 is a view for illustrating a configuration example of a related-art NG liquefaction apparatus. In FIG. 4, there is illustrated an example in which equipment groups forming the NG liquefaction apparatus are classified into the HE-side equipment group, the CE-side equipment group, and the ACHE group 4, and are arranged in different structures 30, respectively. Specifically, only the HE-side equipment group is arranged in the structure 30 of an HE module 3*a*', and only the CE-side equipment group is arranged in the structure 30 of the CE module 3*b*. In addition, only the ACHE groups 4 are arranged on the upper surface of the structure 30 of an ACHE module 3*c*.

When the HE module 3*a*', the CE module 3*b*, and the ACHE module 3*c* are separated from each other as in the NG liquefaction apparatus illustrated in FIG. 4, the number of modules forming the NG liquefaction apparatus is increased. Therefore, in an installation site of the modules 3*a*', 3*b*, and 3*c*, cost of setting of connection pipes configured to connect the modules 3*a*', 3*b*, and 3*c* and a connecting operation of electric cables rises, and in addition, it is difficult to reduce man-hour required for the above-mentioned construction work.

In order to solve the above-mentioned problem, when the plurality of modules 3*a*', 3*b*, and 3*c* can be integrated with each other under a state in which a larger number of equipment are incorporated into the common structure 30 in each of the modules 3*a*', 3*b*, and 3*c* illustrated in FIG. 4, the number of the modules can be reduced, leading to the solution to the above-mentioned problem.

In addition, a more compact NG liquefaction apparatus can also be configured by reducing a gap to be defined between arrangement positions of the modules 3*a*', 3*b*, and 3*c* and an unused space in the structure 30.

Meanwhile, the ACHE 41 provided on the upper surface of the ACHE module 3*c* is configured to rotate a fan (not shown) to take in air for cooling from a lower side and discharge the air having cooled a fluid to be cooled, which flows in a tube (not shown), toward an upper side.

When leakage of a combustible fluid or the like occurs on a lower side of the ACHE 41 during operation in the ACHE module 3*c*, air containing the combustible component is sucked up, and there is also a risk in that the air may scatter in a setting region of the NG liquefaction apparatus through the ACHE 41. In addition, when a cryogenic liquid flows out, there is a risk in that a steel structure forming the structure 30 and the like may be subjected to damage such as low-temperature fracturing. When the cryogenic substance scatters through the ACHE 41, there is also a risk in that a damage range may be enlarged.

Here, as illustrated in FIG. 4, in a space on a lower side of each the ACHE groups 4 in the related-art ACHE module 3*c*, there is a pipe rack in which a large number of pipes 42 are arranged. In the large number of pipes 42, a fluid to be cooled by the ACHEs 41 and other fluids transferred between various processing blocks (gas-liquid separation block 11, mercury removing block 12, acid gas removing block 13, moisture removing block 14, liquefaction processing block 15, and rectifying block 151) of the HE module 3*a*' and the CE module 3*b* flow.

In the pipes 42, a risk of leakage of a fluid can be suppressed to a local range by minimizing a portion, which may cause leakage, such as a flange portion.

Meanwhile, the HE-side equipment group and the CE-side equipment group arranged in the HE module 3*a*' and the CE module 3*b* also include equipment each having a volume larger than that of the pipes and the like. Therefore, even when the supply of a fluid to those equipment is stopped at a time of occurrence of leakage, there is a risk in that an outflow on a larger scale may occur.

As described above, further integration of the modules 3*a*', 3*b*, and 3*c* illustrated in FIG. 4 is required to be performed under a state in which the influence associated with the implementation of the integration is accurately grasped, and sufficient safety is ensured.

In view of the foregoing, in the NG liquefaction apparatus according to the embodiment of the present invention, among the equipment included in the HE-side equipment group and the CE-side equipment group, the equipment configured to handle combustible liquids, flammable liquids each having a relatively low flashing point among the combustible liquids, and liquefied petroleum gas (LNG/LPG) were listed.

In particular, liquids handled in the NG liquefaction apparatus have combustibility and flammability, and in addition, are increased in volume due to vaporization in many cases. Therefore, it is required to pay sufficient attention to handling of those liquids on the lower side of the ACHE 41.

From the above-mentioned viewpoint, in FIG. 2 to FIG. 4, among the equipment included in the HE-side equipment group and the CE-side equipment group, equipment (handling equipment 62 and 72) configured to handle a combustible liquid, a flammable liquid, and LNG/LPG are hatched. In addition, equipment (non-handling equipment 61 and 71) that do not handle those substances are illustrated in a blank state.

As schematically illustrated in FIG. 4, most of the equipment in the CE-side equipment group arranged in the CE module 3*b* are the handling equipment 72. Thus, the occupancy rate of the handling equipment 72 in the module is high, whereas the occupancy rate of the non-handling equipment 71 is relatively low.

In contrast, in the HE-side equipment group arranged in the HE module 3*a*', as compared to the CE-side equipment group, the occupancy rate of the handling equipments 62 in the module is low, whereas the occupancy rate of the non-handling equipments 61 is high.

Focus is given on the above-mentioned features of the HE-side equipment group and the CE-side equipment group, and as illustrated in FIG. 2 and FIG. 3, the NG liquefaction apparatus according to the embodiment of the present invention has a configuration in which the HE module 3*a* is combined with the CE module 3*b*. In the HE module 3*a*, only the equipment belonging to the HE-side equipment group are provided in the structure 30 having the ACHE groups 4 each being arranged on an upper surface side. In the CE module 3*b*, the CE-side equipment group is arranged in the structure 30 in which the ACHE group 4 is not provided as in the related art.

Meanwhile, as described above, the HE-side equipment group also includes the handling equipments 62 configured to handle a combustible liquid, a flammable liquid, and LNG/LPG; and hence in the HE module 3*a* according to the embodiment of the present invention, modules are integrated with each other in consideration of the presence of the handling equipments 62.

Now, the detailed configuration of the HE module 3*a* (hereinafter sometimes referred to as "composite HE module 3*a*") according to the embodiment of the present invention is described.

As illustrated in FIG. 2 and FIG. 3, the composite HE module 3*a* includes the structure 30 having a rectangular planar shape. The structure 30 is a steel structure structure in which required portions are covered with a refractory material such as concrete or a synthetic resin and a cold-resistant material (also having refractory ability) for protection from a cryogenic liquid.

The ACHE groups 4 each including a large number of ACHEs 41 are arranged on the upper surface of the structure 30. In the composite HE module 3*a* according to the embodiment of the present invention, a plurality of columns (for convenience of illustration, an example of three columns is illustrated in FIG. 2) of the ACHEs 41 are provided on the upper surface of the structure 30 in a width direction of the structure 30, each column having the plurality of ACHEs 41 arranged in a front-and-back direction, to thereby configure an arrangement area of each of the ACHE groups 4. In the composite HE module 3*a* according to the embodiment of the present invention, two arrangement areas of the ACHE groups 4 are arranged on the upper surface of the structure 30 in the front-and-back direction with a gap defined therebetween.

In a space on a lower side of the arrangement area of each of the ACHE groups 4, there is a pipe rack in which the large number of pipes 42 are arranged in the same manner as in the ACHE module 3*c* in the related art illustrated in FIG. 4.

In addition, as illustrated in FIG. 2 and FIG. 3, in the composite HE module 3*a* according to the embodiment of the present invention, each of the structures 30 is provided so as to extend to a front side of the arrangement area of the ACHE group 4. The HE-side equipment group is arranged in the extended structure 30 and the space on the lower side of the ACHE group 4. This arrangement is different from that of the HE module 3*a*' and the ACHE module 3*c* in the related art.

As described above, when the space on the lower side of the ACHE group 4 is utilized as a space in which the HE-side equipment group is arranged, the volume of the composite HE module 3*a* after integration illustrated in FIG. 3 can also be reduced as compared to the total volume of the HE module 3*a*' and the ACHE module 3*c* illustrated in FIG. 4.

In FIG. 2, in order to illustrate the arrangement of the equipment on the lower side of each of the ACHE groups 4 in an easy-to-understand manner, a part of the ACHE group 4 positioned on an upper side of those equipment is cut away.

In addition, in the following description, a region in which the ACHE group 4 is arranged on the upper surface of the structure 30 is also referred to as "arrangement area A1", and a region in which the ACHE group 4 is not arranged on the upper surface of the structure 30 is also referred to as "non-arrangement area A2" (see FIG. 3).

As a basic design policy of the composite HE module 3*a*, among the equipment forming the HE-side equipment group, the handling equipment 62 is preferentially arranged in the non-arrangement area A2 (handling equipment 62*b* in FIG. 2 and FIG. 3).

For example, in the HE module 3*a*' illustrated in FIG. 4, the handling equipment 62*b* is arranged at a position adjacent to the ACHE module 3*c*, and there is a space in which the handling equipment 62*b* can be arranged on the lower side of the ACHE 41. In this case, when the HE module 3*a*' and the ACHE module 3*c* are integrated with each other, it also seems to be natural to arrange the handling equipment 62*b* on the lower side of the ACHE 41.

However, the handling equipment 62*b* is configured to handle a combustible liquid, a flammable liquid, and LNG/LPG Therefore, consideration is made regarding whether or not it is possible to change layout with priority being given to the arrangement of the handling equipment 62*b* in the non-arrangement area A2 that is less liable to be influenced by the ACHEs 41 even when leakage of those fluids occurs.

As a result, when it is possible to change the arrangement position of the handling equipment 62*b* as illustrated in FIG. 3, the layout is changed, and the non-handling equipment 61 is arranged in the arrangement area A1 to the extent possible (non-handling equipment 61*a* in FIG. 3).

Even when consideration is made so as to preferentially arrange the handling equipment 62 in the non-arrangement area A2 as described above, there is also a case in which it is inevitable that the handling equipment 62 be arranged in the arrangement area A1 for convenience of an arrangement space (handling equipment 62*a* in FIG. 2 and FIG. 3).

In this case, an early response and prevention of expansion of an influence at a time of occurrence of leakage are performed by providing at least one security facility selected from a security facility group consisting of a gas detector, a sprinkler, a refractory cover, and a depressurized line in parallel to the handling equipment 62*a* arranged in the arrangement area A1.

In American Petroleum Institute (API) Publication 2218, which is International Design Standards on the safety of the NG liquefaction apparatus and an oil and gas plant, for example, a petroleum refining apparatus, an implementation range of a refractory covering in the arrangement area A1 of the ACHE group 4 is defined.

In the composite HE module 3*a* according to the embodiment of the present invention, consideration is made of layout in which the handling equipment 62 is prevented from being arranged in the arrangement area A1 to the extent possible, and then, an optimum safety facility is set with respect to the handling equipment 62*a* that is inevitably required to be arranged in the arrangement area A1. With this, the composite HE module 3*a* in which sufficient safety is ensured can be obtained while the cost of additional refractory design in association with module construction is minimized.

In addition, for example, when a delivery destination of the LNG is located on the arrangement area side of the HE when viewed from the NG liquefaction apparatus, even in the case in which equipment (for example, an end flash drum for temperature regulation of the LNG) configured to deliver the LNG are included in the CE-side equipment group, the equipment is inevitably required to be arranged in the composite HE module 3*a* in some cases.

In this case, based on the same approach as that of the handling equipment 62*a* and 62*b* of the HE-side equipment group, consideration is first made of layout in which the handling equipment 72 is prevented from being arranged in the arrangement area A1 to the extent possible, and then, the above-mentioned security facility is provided in parallel to a handling equipment 72*a* that is inevitably required to be arranged in the arrangement area A1 (handling equipment 72*b* and 72*a* in FIG. 2).

Based on the above-mentioned approach, the composite HE module 3*a* including the gas-liquid separation block 11, the mercury removing block 12, the acid gas removing block 13, the moisture removing block 14, and the rectifying block 151, which are the processing blocks on the HE side, and the plurality of composite HE modules 3*a*, each including the handling equipment 72 for delivery of the LNG as necessary, are constructed. In this case, the processing blocks 11, 12, 13, 14, and 151 may be divided into the plurality of composite HE modules 3*a*, or the plurality of processing blocks 11, 12, 13, 14, and 151 may be provided in one composite HE module 3*a*.

In addition, except for the composite HE module 3*a*, the CE module 3*b* in which the CE-side equipment group is arranged in the structure 30 and which has the same configuration as that of the related art, and the refrigerant compressors 21 that are the MR compressor and the C3 compressor are constructed.

In the example of the NG liquefaction apparatus illustrated in FIG. 2, the plurality of composite HE modules 3*a* are arranged in one column in a horizontal direction under a state in which the arrangement areas A1 of the ACHE groups 4 are directed in the same direction.

The plurality of CE modules 3*b* each including the CE-side equipment group are arranged side by side in one column on a back side of the column of the composite HE modules 3*a* with an area, in which the arrangement areas A1 of the ACHE groups 4 arranged side by side in the horizontal direction, interposed therebetween. The refrigerant compressors 21 that are the C3 compressor and the MR compressor are arranged on the left and right sides with the column of the CE modules 3*b* interposed therebetween, and thus the NE liquefaction apparatus according to the embodiment of the present invention is configured.

The composite HE modules 3*a*, the CE modules 3*b*, and the refrigerant compressors 21 are connected to each other through connection pipes or the like as described above, but the pipes are omitted in FIG. 2.

The composite HE module 3*a* according to the embodiment of the present invention has the following effect. Of the equipment groups forming the NG liquefaction apparatus, the HE-side equipment group and the ACHE group 4, in which the occupancy rate of the equipment (handling equipment 62) configured to handle a combustible liquid, a flammable liquid, and LNG/LPG is low, are arranged in the common structure 30 to configure the composite HE module 3*a*. As a result, the composite HE module 3*a* having a higher integration degree can be configured while the additional refractory cost in accordance with API2218 is minimized, as compared to the CE-side equipment group for liquefaction of natural gas, in which the occupancy rate of the handling equipment configured to handle the above-mentioned liquids is high.

As a result, the composite HE module 3*a* and the CE module 3*b* involving less site operation steps in a module installation site can be designed, and the NG liquefaction apparatus in which initial investment cost is minimized can be configured.

In this case, the configuration of the NG liquefaction apparatus is not limited to the example of FIG. 1. As necessary, the setting of a part of the processing blocks on the HE side may be omitted, and a processing block having another purpose may be provided.

The invention claimed is:

1. A module for a natural gas liquefaction apparatus for configuring the natural gas liquefaction apparatus, the module for the natural gas liquefaction apparatus comprising:

a structure;

air-cooled heat exchanger groups, which are arranged side by side on an upper surface of the structure, and are each configured to cool a fluid handled in the natural gas liquefaction apparatus;

a pretreatment unit equipment group, which is arranged in an extended structure and a space on a lower side of each of the air-cooled heat exchanger groups, wherein the extended structure is provided to extend to a front side of each of the air-cooled heat exchanger groups and the pretreatment unit equipment group is configured to perform pretreatment of natural gas before being liquefied, or a portion of the pretreatment unit equipment group is arranged to be separated from air-cooled heat exchanger groups, wherein the space on a lower side of each of the air-cooled heat exchanger groups is not provided with a liquefaction processing unit equipment group associated with processing of liquefying the natural gas after being treated in the pretreatment unit equipment group.

2. The module for the natural gas liquefaction apparatus according to claim 1, wherein the structure is partitioned into an arrangement area in which the air-cooled heat exchanger group is arranged on the upper surface of the structure and a non-arrangement area in which the air-cooled heat exchanger group is prevented from being arranged on the upper surface of the structure, and wherein, among equipments included in the pretreatment unit equipment group, only a non-handling equipment is provided in the structure on the arrangement area side, the non-handling equipment being prevented from handling a liquid selected from a liquid group consisting of a combustible liquid, a flammable liquid, liquefied natural gas, and liquefied petroleum gas, and remaining equipment is provided in the structure on the non-arrangement area side.

3. The module for the natural gas liquefaction apparatus according to claim 1, wherein the structure is partitioned into an arrangement area in which the air-cooled heat exchanger group is arranged on the upper surface of the structure and a non-arrangement area in which the air-cooled heat exchanger group is prevented from being arranged on the upper surface of the structure, and wherein, among equipments included in the pretreatment unit equipment group, a handling equipment is provided in the structure on the arrangement area side, the handling equipment being configured to handle a liquid selected from a liquid group consisting of a combustible liquid, a flammable liquid, liquefied natural gas, and liquefied petroleum gas, and wherein at least one security facility selected from a security facility group consisting of a gas detector, a sprinkler, a refractory cover, and a depressurized line is provided in parallel to the handling equipment provided in the structure on the arrangement area side.

4. The module for the natural gas liquefaction apparatus according to claim 1, wherein the structure is partitioned into an arrangement area in which the air-cooled heat exchanger group is arranged on the upper surface of the structure and a non-arrangement area in which the air-cooled heat exchanger group is prevented from being arranged on the upper surface of the structure, and wherein an equipment included in the liquefaction processing unit equipment group is provided in the structure on the non-arrangement area side.

5. The module for the natural gas liquefaction apparatus according to claim 4, wherein the equipment included in the liquefaction processing unit equipment group is an equipment configured to deliver the liquefied natural gas from the natural liquefaction apparatus.

6. The module for the natural gas liquefaction apparatus according to claim 1, wherein the pretreatment unit equipment group includes at least one natural gas pretreatment equipment unit selected from a pretreatment equipment unit group consisting of a gas-liquid separation unit configured to separate a liquid component contained in the natural gas, a mercury removal unit configured to remove mercury contained in the natural gas, an acid gas removal unit configured to remove acid gas contained in the natural gas, a moisture removal unit configured to remove moisture contained in the natural gas, and a heavy component removal unit configured to remove a heavy component contained in the natural gas.

7. A natural gas liquefaction apparatus, comprising:

a plurality of modules for the natural gas liquefaction apparatus of claim 1; and another module for the natural gas liquefaction apparatus in which the liquefaction processing unit equipment group is provided in a structure.

8. The natural gas liquefaction apparatus according to claim 7, wherein the structure of each of the plurality of modules is partitioned into an arrangement area in which the air-cooled heat exchanger group is arranged on the upper surface of the structure and a non-arrangement area in which the air-cooled heat exchanger group is prevented from being arranged on the upper surface of the structure, and wherein, among equipments included in the pretreatment unit equipment group, only a non-handling equipment is provided in the structure on the arrangement area side, the non-handling equipment being prevented from handling a liquid selected from a liquid group consisting of a combustible liquid, a flammable liquid, liquefied natural gas, and liquefied petroleum gas, and remaining equipment is provided in the structure on the non-arrangement area side.

9. The natural gas liquefaction apparatus according to claim 7, wherein the structure of each of the plurality of modules is partitioned into an arrangement area in which the air-cooled heat exchanger group is arranged on the upper surface of the structure and a non-arrangement area in which the air-cooled heat exchanger group is prevented from being arranged on the upper surface of the structure, and wherein, among equipments included in the pretreatment unit equipment group, a handling equipment is provided in the structure on the arrangement area side, the handling equipment being configured to handle a liquid selected from a liquid group consisting of a combustible liquid, a flammable liquid, liquefied natural gas, and liquefied petroleum gas, and wherein at least one security facility selected from a security facility group consisting of a gas detector, a sprinkler, a refractory cover, and a depressurized line is provided in parallel to the handling equipment provided in the structure on the arrangement area side.

10. The natural gas liquefaction apparatus according to claim 7, wherein the structure of each of the plurality of modules is partitioned into an arrangement area in which the air-cooled heat exchanger group is arranged on the upper surface of the structure and a non-arrangement area in which the air-cooled heat exchanger group is prevented from being arranged on the upper surface of the structure, and wherein an equipment included in the liquefaction processing unit equipment group is provided in the structure on the non-arrangement area side.

11. The natural gas liquefaction apparatus according to claim 10, wherein the equipment included in the liquefaction processing unit equipment group is an equipment configured to deliver the liquefied natural gas from the natural liquefaction apparatus.

12. The natural gas liquefaction apparatus according to claim 7, wherein the pretreatment unit equipment group includes at least one natural gas pretreatment unit selected from a pretreatment equipment unit group consisting of a gas-liquid separation unit configured to separate a liquid component contained in the natural gas, a mercury removal unit configured to remove mercury contained in the natural gas, an acid gas removal unit configured to remove acid gas contained in the natural gas, a moisture removal unit configured to remove moisture contained in the natural gas, and a heavy component removal unit configured to remove a heavy component contained in the natural gas.

* * * * *